United States Patent [19]

Bellows

[11] Patent Number: 4,552,204

[45] Date of Patent: Nov. 12, 1985

[54] MEANS FOR LIFTING HEATING ELEMENT BASKETS

[75] Inventor: Kenneth O. Bellows, Wellsville, N.Y.

[73] Assignee: The Air Preheater Company, Inc., Wellsville, N.Y.

[21] Appl. No.: 557,034

[22] Filed: Dec. 1, 1983

[51] Int. Cl.[4] ..... F28D 19/04

[52] U.S. Cl. ..... 165/10; 165/8

[58] Field of Search ..... 165/10, 8

[56] References Cited

U.S. PATENT DOCUMENTS

| | | | |
|---|---|---|---|
| 2,432,198 | 12/1947 | Karlsson et al. | 165/10 |
| 4,182,402 | 1/1980 | Adrian | 165/10 |
| 4,209,060 | 6/1980 | Wiking et al. | 165/10 |

*Primary Examiner*—Albert W. Davis, Jr.

*Attorney, Agent, or Firm*—David L. Smith

[57] ABSTRACT

Element basket (55) includes lifting means (66, 74) integral with element holding bar (64) to facilitate removing element baskets from or placing element baskets into a rotary regenerative heat exchanger (20).

1 Claim, 14 Drawing Figures

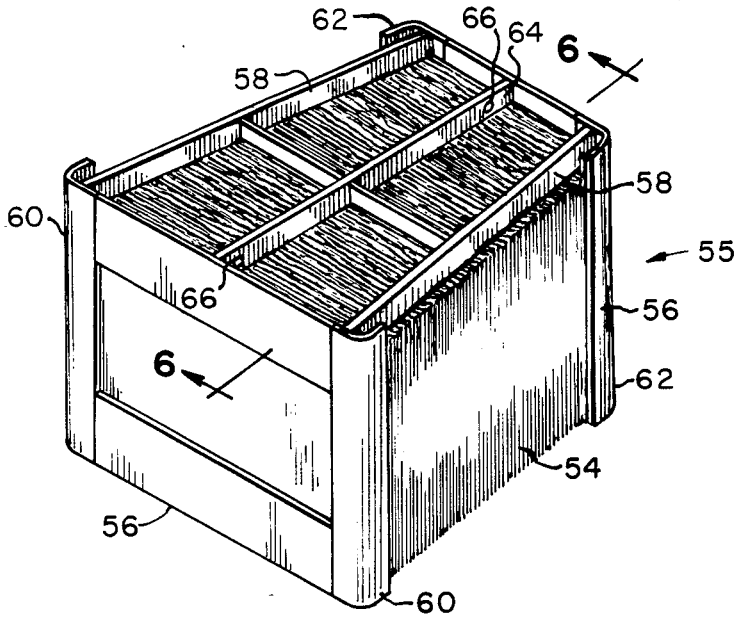
FIG. 4
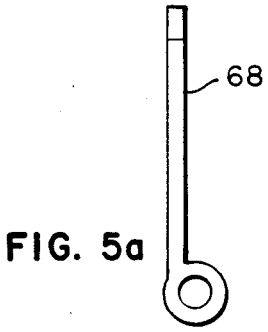
FIG. 5a
FIG. 5b
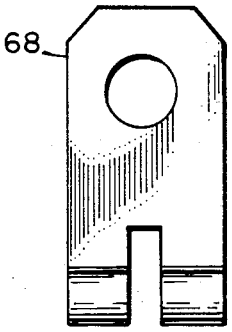
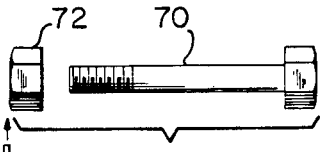
FIG. 5c
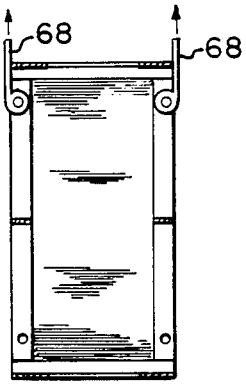
FIG. 6
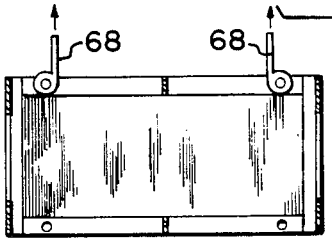
FIG. 7

MEANS FOR LIFTING HEATING ELEMENT BASKETS

BACKGROUND OF THE INVENTION

The present invention relates to rotary regenerative heat exchangers, and more particularly, to an element basket adapted to facilitate removing element baskets from or placing element baskets into a rotary regenerative heat exchanger.

A rotary regenerative heat exchanger comprises a rotor that carries heat transfer material that is alternately rotated first into a hot gas stream to absorb heat therefrom and then into a cooler gas stream to impart heat thereto. The heat exchange material carried by the rotor generally comprises a mass of heat absorbent plates. The plates are assembled in an orderly array and positioned within element baskets that firmly hold the plates in a predetermined space relationship in order that they may be easily handled and arranged in the rotor of the rotary regenerative heat exchanger.

Hot gases, usually generated by combusting a fossil fuel in a furnace, pass into the heat exchanger and thence over the heat absorbent material contained therein. As the gas flows through the heat absorbent material, the heat absorbent material erodes, corrodes, becomes loosened in the element baskets, and becomes covered with particulate materials deposited from the combustion gases. Therefore, it is necessary that the element baskets be periodically removed and replaced.

In the prior art, it was necessary to provide a space between the center element holding bar and the end edges of the heating elements contained within a heating element basket such that a hook could be inserted therebetween for lifting the heating element basket. The prior art heating element basket lifting means provided a single point of support as a heating element basket was removed from or placed into the rotor. Since the heating element baskets are trapezoidal in cross sectional area such that lifting the heating element baskets from the center point of the center top element holding bar would result in a rotational moment that would cause the heating element basket to bind as the heating element basket was removed from or placed into the rotor. Locating the precise point along the top center element holding bar that would result in no moments and therefore eliminate binding would require a trial and error process and be virtually impossible when removing heating element baskets that have been subjected to erosion and particulate material buildup. Furthermore, the space required between the center element holding bar and the heating elements to accommodate the hook for lifting results in an undesirable empty space within the heat exchanger which cannot be used for heat exchange and, therefore, results in an increase is the overall height of the heat exchanger.

SUMMARY OF THE INVENTION

The present invention contemplates a heating element basket adapted to faciliate lifting. According to the present invention, lifting means are provided integral with the element holding bars for lifting the heating element baskets. The lifting means provide at least two points on the element holding bars at the end of the heating element basket from which the heating element basket is lifted thereby obviating the need for a space between the center element holding bar and the end edges of the heating elements. Providing lifting means of at least two points on each heating element basket reduces the binding experienced due to moments to about a single lifting point. Eliminating the unnecessary space between the center element holding bar and the heating elements permits a reduction in the height of the heating element basket or alternatively increasing the height of the heating elements and therefore increasing the area of heat transfer surface, both of which may result in a decrease in the overall height of the heat exchanger.

BRIEF DESCRIPTION OF THE DRAWING

FIG. 4 is a perspective view of a heating element basket designed in accordance with the present invention;

FIG. 5(*a*) is a side view of a clevis;

FIG. 5(*b*) is a front view of the clevis shown in FIG. 5(*a*); and

FIG. 5(*c*) is a clevis retaining pin used in conjunction with the clevis shown in FIGS. 5(*a*) and 5(*b*) as well as with the heating element basket lifting means shown in FIG. 4;

FIG. 6 is a sectional view of a heating element basket taken along the line 6—6 of FIG. 4, shown being lifted during manufacture;

FIG. 7 is a sectional view of a heating element basket taken along the line 6—6 of FIG. 4, shown being lifted during placement into or removal from a rotary regenerative air heater;

FIG. 9(*b*) is a front view of the clevis-like hook shown in FIG. 9(*a*) and used in conjunction with the lifting means embodied in the heating element basket of FIG. 8;

DESCRIPTION OF THE PREFERRED EMBODIMENT

Figure 1:
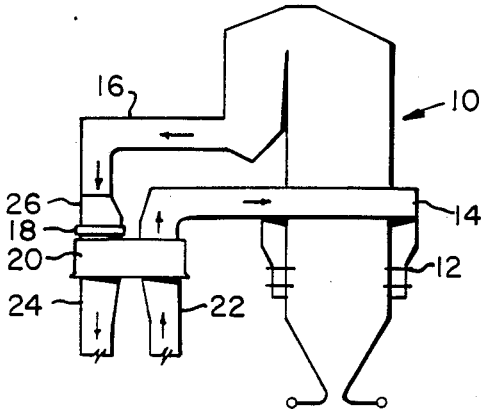
FIG. 1 is a side view of a fossil fuel-fired furnace incorporating a rotary regenerative air heater.

Depicted in FIG. 1 of the drawing there is furnace 10 wherein a fossil fuel, introduced through burners 12, is combusted. Combustion air is introduced into furnace 10 through air supply duct 14. Hot particle laden combustion gases formed in furnace 10 upon combustion, pass from furnace 10 through duct 16 and gas damper 18 to rotary regenerative air heater 20. Combustion air, typically at ambient temperature, is supplied to the rotary regenerative heat exchanger 20, termed an air heater, through inlet duct 22. The air passing through rotary regenerative air heater 20 is passed in heat exchange relationship with the hot gases and thereby preheated prior to introduction into furnace 10. After giving up heat in the rotary regenerative air heater 20, the combustion gases are discharged to the atmosphere through duct 24. A gas duct 26 is disposed between the furnace gas duct 16 and rotary regenerative air heater 20 to isolate any forces generated by furnace expansion so that the rotary regenerative air heater 20 is not subjected to and damaged by such forces.

Figure 2:
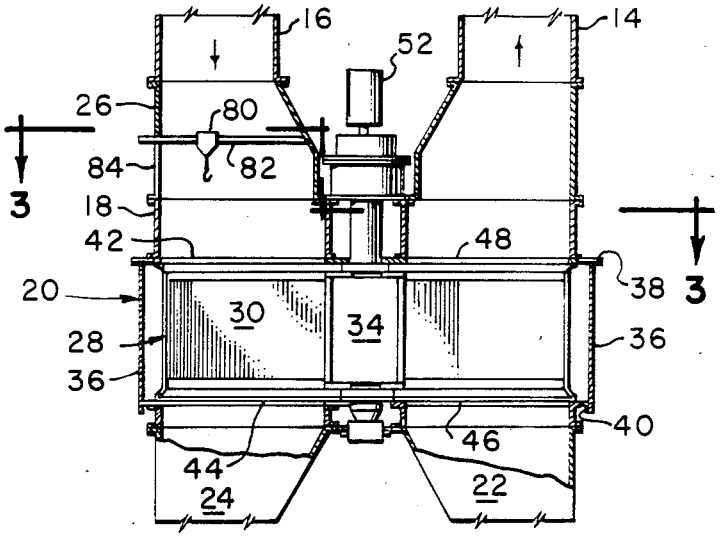
FIG. 2 is a sectional view of a rotary regenerative air heater.
Figure 3:
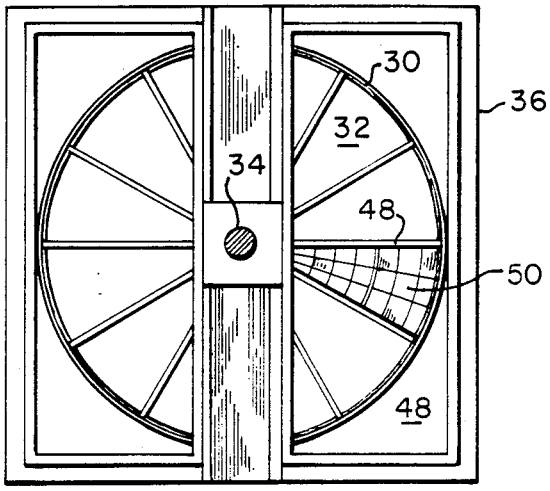
FIG. 3 is a top plan view of a rotary regenerative air heater taken along line 3—3 of FIG. 2.

As best shown in FIGS. 2 and 3, there is depicted therein a rotary regenerative air heater assembly comprising an air heater, a gas damper, a gas duct and a tracking means disposed within the gas duct either upstream or downstream of the gas damper for supporting and guiding a hoist. The air heater rotor 28 comprises a shell 30 formed of a plurality of sector-shaped compartments 32 extending radially from a vertical rotor post 34. The rotor 28 is enclosed in housing 36 which is provided with end plates 38 and 40 that are formed with circumferentially spaced openings 42, 44, 46 and 48 which serve as the gas inlet, gas outlet, the air inlet, and the air outlet, respectively, to the air heater for directing the flow of streams of heating gas and air to be heated to and through rotor 28.

Conventionally, rotor 28 carries a mass of heat absorbent material 50 that is contacted by the stream of hot gas leaving furnace 10 through exit gas duct 16 and entering the air heater housing 36 through inlet opening 42 and exhausted therefrom through outlet opening 44 after having traversed the heat absorbent material 50 disposed within the rotor 28. Ambient air to be heated enters the air heater housing 36 through inlet opening 46 and is exhausted therefrom through outlet opening 48 after having traversed the heated heat absorbent material 50 disposed within the rotor 28. While the hot gases and air are traversing their respective passages through air heater housing 36, the rotor 28 is being rotated about rotor post 34 by drive means 52, such as a motor, so that the heat absorbent material 50 contained therein is alternately exposed to the heating gas and the air to be heated.

The heat exchange material 50 carried by rotor 28 comprises a plurality of element baskets 55, each of which comprises a mass of heat absorbent element plates 54 assembled in an orderly array in spaced relationship and positioned edgewise in basket housing 56 that firmly hold the plates in their predetermined spaced relationship in order that they may be easily handled as an integral unit when arranged in the rotor 28 of the air heater as best seen in FIG. 4. Typically, the horizontal cross section of the element basket is trapezoidal as shown in FIG. 4. Each element basket 55 is positioned within a sector 32 of rotor 28. Each sector 32 contains multiple layers of element baskets 55 with multiple element baskets 55 in each layer. Typically, an element basket 55 may be as much as three feet wide, three feet deep and almost four feet high. The hot gases and the air to be heated flow over plates 54 through the flow passageways between the spaced plates as the hot gas and air traverse the rotor 28.

Basket housing 56 is typically formed of an outer end plate 60 that forms the end of element basket 55 coinciding with the longer parallel segment of the horizontal, trapezoidal cross section interconnected by bars 58 with an inner end plate 62 that forms the end of element basket 55 coinciding with the shorter parallel segment of the horizontal trapezoidal cross section to form an enclosure in which the plates 54 are housed. At least one element holding bar 64 is disposed at each end of the element basket 55 to extend traversely across and abut the end edges of the plates 54 between outer end plate 60 and inner end plate 62. Element holding bar 64 divides each end of element basket 55 symmetrically thereabout. It is to be understood, however, that the particular embodiment of the basket housing 56 described herein is not limiting of the invention. The basket housing may be any form of open-ended enclosure capable of housing the plates 54 in edgewise fashion therein.

After a set of element baskets 55 has been in service for a period of time there is a tendency for the heat absorbent plates 54 to corrode and erode away due to their being in continuous contact with the hot gases which are often laden with particulate matter and corrosive compounds. Accordingly, element baskets are periodically removed and reversed such that although the hot gas flow passes from duct 16 through rotor 28 into duct 24 the former leading edge of heat absorbent plates 54 subjected to the hot gases is moved from being adjacent to opening 42 and placed adjacent duct 24. After being in service in the reversed flow direction for a period of time a set of element baskets 55 must be replaced. Additionally, there is a tendency for the individual heat absorbent plates 54 to become loose within an element basket 55 during periodic cleaning by high-pressure air blast. Accordingly, it is necessary that the element baskets 55 be replaced periodically in order to maintain heat transfer efficiency within the air heater.

In accordance with the present invention, means are provided for lifting element basket 55 that are integral with element holding bars 64. The lifting means provide at least two points from which element basket 55 is simultaneously lifted with each point carrying the respective portion of the weight of element basket 55.

In the embodiment of the present invention, shown in FIG. 4, the lifting means is comprised of two holes 66 passing through element holding bar 64 with the first hole 66 through element holding bar 64 adjacent the inner end plate 62 and the second hole 66 through element holding bar 64 adjacent outer end plate 60.

When lifting the element basket 55, the clevis 68, clevis pin 70 and clevis securing means 72 shown in FIG. 5 are used in conjunction with the embodiment of the present invention shown in FIG. 4. To lift the element basket 55 a clevis 68 is positioned to span holding bar 64 about hole 66. Then a clevis pin 70 is passed through the clevis 68 and hole 66 and secured by clevis nut 72. FIG. 6 shows element basket 55 being lifted from the outer end plate end during manufacture using the present invention. FIG. 7 shows an element basket 55 being lifted using this embodiment of the invention during installation or removal from a rotor.

Figure 8:
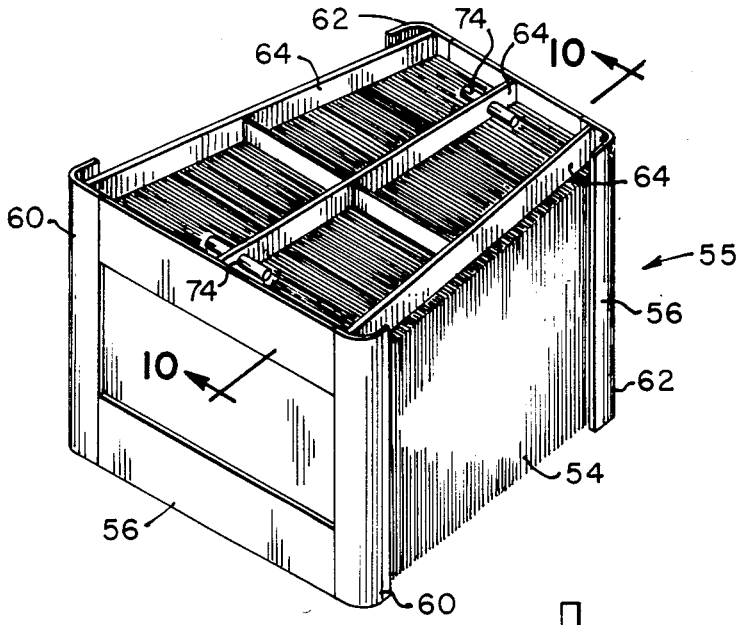
FIG. 8 is a perspective view of a heating element basket embodying an alternate embodiment designed in accordance with the present invention.
Figure 9A:
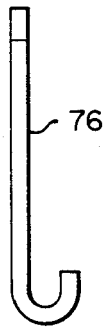
FIG. 9(*a*) is a side view of a clevis-like hook.
Figure 9B:
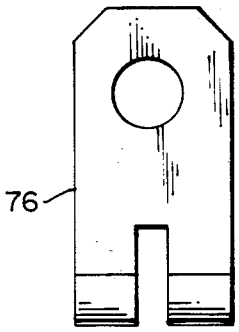
Figure 10:
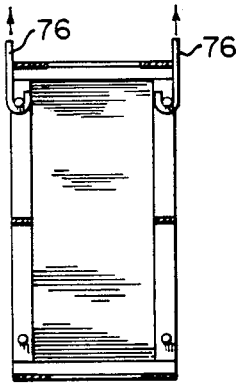
FIG. 10 is a sectional view of a heating element basket taken along the line 10—10 of FIG. 8 and shown being lifted during manufacture.
Figure 11:
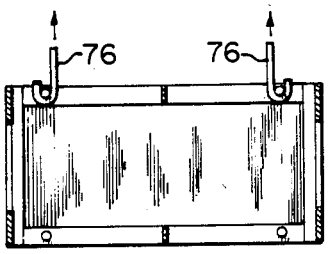
FIG. 11 is a sectional view of a heating element basket taken along the line 10—10 of FIG. 8 and shown being lifted during placement into or removal from a rotary regenerative air heater.

In the embodiment of the present invention shown in FIG. 8, the lifting means is comprised of two pins 74 integral with the element holding bar 64 with the first pin 74 extending through element holding bar 64 adjacent to inner end plate 62 and the second pin 74 extending through element holding bar 64 adjacent outer end plate 60. When lifting the element basket 55, the hook-like clevis 76 of FIG. 9 is used in conjunction with the embodiment of the present invention shown in FIG. 8 to lift an element basket 55. To lift the element basket 55, a hook-like clevis 76 is positioned to engage pin 74. FIG. 10 shows an element basket 55 being lifted from the outer end plate 60 and using this embodiment during manufacture whereas FIG. 11 shows an element basket 55 being lifted using this embodiment during installation or removal from a rotor.

To remove an element basket 55, the rotor 28 is rotated about rotor post 34 until the element basket to be removed lies directly below the gas inlet 42 to the air heater housing 36. The hoist 80 is guided along track means 82 until it lies directly above the element basket to be removed. The track means 82 extends radially across the rotor 28 so that it may be selectively positioned at any location across the radial expanse of the rotor 28. Once correctly positioned, the hoist 80 is activated to hook onto the element basket to be removed by hooking onto either clevis 68 or hook-like clevis 76, whichever has been previously attached to the element basket to be removed, depending upon the embodiment of the invention utilized. Once properly hooked, the element basket is lifted by hoist 80 upwardly out of the rotor 28 through the gas inlet 42 in air heater housing 36. The hoist 80 is then moved to a position adjacent the wall of the gas duct 26 and the element basket removed through the access opening 84 and replaced with a new element basket. The new element basket is properly positioned within its sector 32 of the rotor 28 by reversing the aforedescribed steps.

I claim:

1. A basketed heating element for use in a rotary regenerative heat exchanger comprising:

an open ended housing defining a volume;

a plurality of heating element plates disposed in spaced relation within the volume defined by the open ended housing;

an element holding bar extending transversely across each open end of the housing so as to divide each open end of the housing summetrically thereabout and to retain the heating element plates therein;

two spaced apart holes through the element holding bar, the first hole positioned near one end of the element holding bar and the second hold positioned near the opposite end of the element holding bar;

clevis means for spanning the element holding bar about each of said holes; and a clevis pin for inserting through each clevis and the hold in the element holding bar which the clevis spans.

* * * * *